United States Patent [19]

Winey

[11] Patent Number: 4,471,172

[45] Date of Patent: Sep. 11, 1984

[54] PLANAR DIAPHRAGM TRANSDUCER WITH IMPROVED MAGNETIC CIRCUIT

[75] Inventor: James M. Winey, White Bear Lake, Minn.

[73] Assignee: Magnepan, Inc., White Bear Lake, Minn.

[21] Appl. No.: 353,846

[22] Filed: Mar. 1, 1982

[51] Int. Cl.[3] ..... H04R 9/00

[52] U.S. Cl. ..... 179/115.5 PV

[58] Field of Search ..... 179/115.5 PV, 115.5 ES, 179/115.5 VC, 115.5 DV, 115.5 R; 181/170, 173

[56] References Cited

U.S. PATENT DOCUMENTS

| | | | |
|---|---|---|---|
| 3,674,946 | 7/1972 | Winey | 179/115.5 PV |
| 3,829,623 | 8/1974 | Willis | 179/115.5 PV |
| 3,833,771 | 9/1974 | Collinson | 179/115.5 PV |
| 3,922,502 | 11/1975 | Tabuchi | 179/115.5 PV |
| 3,922,503 | 11/1975 | Tabuchi | 179/115.5 PV |
| 4,242,541 | 12/1980 | Ando | 179/115.5 PV |

FOREIGN PATENT DOCUMENTS

| | | | |
|---|---|---|---|
| 52-20013 | 2/1977 | Japan | 179/115.5 PV |
| 52-43419 | 4/1977 | Japan | 179/115.5 PV |
| 57-65996 | 4/1982 | Japan | 179/115.5 PV |
| 1443491 | 7/1976 | United Kingdom | 179/115.5 PV |

OTHER PUBLICATIONS

S. Rich, "Electrodynamic Loudspeaker . . . ," *Electronics*, Jun. 11, 1961.

*Primary Examiner*—Gene Z. Rubinson
*Assistant Examiner*—L. C. Schroeder
*Attorney, Agent, or Firm*—Peterson, Palmatier, Sturm, Sjoquist & Baker, Ltd.

[57] ABSTRACT

A planar diaphragm type magnetic transducer with magnetic circuit wherein the magnet strips on the soft iron plate and confronting the diaphragm are arranged in a sequence south, north, north, south, south, north, north, south, et seq. The magnet strips are spaced across the transducer and the metal plates on which the magnet strips lie are apertured to make the plates acoustically transparent. Conductors are grouped in runs on the diaphragm opposite alternate pairs of magnet strips which have magnetic poles of opposite polarity at their front faces.

16 Claims, 9 Drawing Figures

PLANAR DIAPHRAGM TRANSDUCER WITH IMPROVED MAGNETIC CIRCUIT

This invention relates to planar diaphragm type magnetic transducers or speakers, and more specifically, to an improved magnetic circuit for such transducers.

BACKGROUND OF THE INVENTION

Diaphragm type magnetic speakers have been known for several years, and usually incorporate a diaphragm or membrane having a vibratable area with a multiplicity of runs of signal carrying conductors thereon. The diaphragm or membrane is spaced from and confronts a generally rigid magnetic backing, usually comprising a multiplicity of permanent magnetized strips lying against an acoustically transparent soft iron plate or armature. The magnetized strips are magnetized so that the front face of each magnetized strip which faces the diaphragm has one polarity and the opposite face of the strip which faces the magnetic plate is the opposite polarity. The magnetized strips are spaced from each other and are magnetized so that all magnetized strips have polarity arrangements opposite to the polarity arrangement of the next adjacent strips. That is to say, the accumulation of spaced magnet strips are polarized so that the adjacent faces have the polarity arranged, north-south-north-south-etc.

Prior transducers have had various physical constructions in the magnetic backing. In U.S. Pat. No. 3,674,946, the magnetized strips are incorporated into a single sheet or slab of magnetic material which is variously magnetized in parallel zones or strips which are spaced from each other. In U.S. Pat. No. 3,919,499, the magnetic backing utilized narrow strips of magnet material, each strip spaced from adjacent strips and suitably magnetized.

In these prior speakers or transducers, conductors on the diaphragm extend parallel to the magnetized strips and are located opposite all the spaces between the several magnets in the magnetic backing.

The arrangement of the magnetized strips has been such that the magnetic fields are formed between the adjacent magnetic poles at the front faces of adjacent magnetized strips; and approximately half of the magnetic field of each magnetized strip is associated with the pole face of the next adjacent strip and the magnetic field related thereto.

It has been recognized in the past that one of the principle problems encountered in the use of the diaphragm type magnetic transducers or speakers has been one of efficiency. In order that the magnetic fields in the vicinity of the conductors on the diaphragm have sufficient strength as to produce significant vibration of the diaphragm in response to application of a signal current through the conductors, it has been necessary to locate the diaphragm quite close to the faces of the magnet strips. It has been typical practice to space the diaphragm approximately sixty thousandths (0.060 inches) from the faces of the magnetized strips in commercial diaphragm type magnetic speakers.

It has been experienced that when a signal current of a substantial magnitude is applied to the conductors on the diaphragm, the diaphragm may have a sufficient excursion from its normal position as to "bottom" or slap against the faces of the magnetized strips. Of course, this bottoming of the diaphragm against the magnetized strips causes a sound which is quite unpleasant and which does not conform at all to the sounds intended to be produced by the signal current being applied.

If the diaphragm is to be prevented from bottoming against the faces of the magnetized strips, the magnitude of the signal current must be reduced, in which case the volume of the sound produced may not be as large as may be desired; or on the other hand, the spacing between the diaphragm and the faces of the magnetized strips must be increased to the point wherein only a minimum of magnetic field surrounds the conductors so that the signal current in the conductors has a significantly lesser effect for the purpose of producing vibration of the diaphragm.

SUMMARY OF THE INVENTION

An object of the invention is to provide a new and improved diaphragm type magnetic transducer or speaker of simple and inexpensive construction and operation.

Another object of the invention is to provide a novel magnetic circuit for a diaphragm type magnetic transducer or speaker which has significantly increased efficiency.

Another object of the invention is to provide an improved diaphragm type magnetic speaker which is adapted to accommodate increased excursion of the diaphragm from its normal position without bottoming or slapping against the magnetic backing.

A still further object of the invention is the provision of an improved magnetic circuit for a diaphragm type magnetic speaker which provides several functional advantages for the speaker in the normal operation thereof.

A principle feature of the present invention is a new and improved magnetic circuit for the planar diaphragm type transducer. The magnetized strips are arranged in functional pairs; and in each pair, the front face of one magnetized strip confronting the diaphragm has a south pole, and the front face of the other strip in the pair has a north pole. In addition, the polarity of each magnetized strip in each of said functional pairs is the same as that of the adjacent magnetized strip of an adjacent functional pair of magnetized strips. In other words, adjacent magnetized strips with opposite polarities at their front faces are a functional pair, cooperating to project a magnetic field embracing a portion of the diaphragm and a run of conductors thereon; each magnetized strip is also adjacent another magnetized strip of like polarity at their front faces. The sequence of spaced magnetized strips is north, south, south, north, north, south, et seq.

As a result, there is a neutral zone between adjacent functional pairs of magnet strips, wherein there is essentially no magnetic field, because the magnetic pole faces at opposite sides of the neutral zone are of like polarity.

On the other hand, magnet strips in each functional pair create a magnetic field of increased intensity between their front faces and the magnetic field has a depth of considerable magnitude in a direction outwardly from the faces of the magnetized strips and toward and beyond the conductors of the diaphragm.

Another feature is that there are conductors only opposite the functional pairs of magnet strips; and there are no conductors opposite the neutral zones between adjacent pairs of magnet strips. At each conductor therefore, the magnetic field is significantly more intense than in previously used magnetic circuits.

In addition, this magnetic circuit arrangement provides a broader base or width of the magnetic field at each pair of magnet strips, thus providing a different shape of magnetic field adjacent the diaphragm and conductors thereon. This different shape is especially important wherein the diaphragm is sandwiched between two magnetic backings incorporating identical magnetic circuits hereinbefore described. In this circumstance, the opposing magnetic fields from the pairs of magnet strips on each side of the diaphragm will adopt a substantially square shape, wherein practically all of the magnetic field and the lines of magnetic flux therein lie parallel to the diaphragm. A wider band of conductors in each run of conductors on the diaphragm is useful in such a magnetic field. The band of conductors may confront the entire functional pair of magnetized strips and more specifically, the magnetized strips of opposite polarity as well as the space therebetween. The band may be, advantageously, as wide as the overall width of the functional pair of magnetized strips and the space therebetween.

The magnetic circuit is useful with speakers with a variety of different types of diaphragms. Accordingly, the diaphragm may be film to flex in its normal vibration, and may be stretched extremely tight or may be relatively loose with only the wrinkles removed. Alternately, the diaphragm may have an essentially rigid vibratable area to move without flexing and connected to the frame by a flexible surround at its periphery.

The magnetic circuit may be made of separate strips of magnet material laid onto a soft iron armature plate with the polarities arranged as specified; or the magnet material may be molded in one panel. Slots may be formed in the panel or slab by molding or by punching out after molding, as to define separate strips as defined and as to avoid use of excessive magnet material.

The advantages of the improved magnetic circuit are primarily to improve the efficiency of the speaker, to intensify the magnetic field at the diaphragm, and to obtain more excursion of the diaphragm in relation to the signal current applied to the speaker, all without increasing the volume or quantity of magnet material used in the magnetic backing. In addition, an advantage is provided in that the spacing between the diaphragm and the faces of the magnetized strips can be signficantly increased to allow greater excursion of the diaphragm without bottoming against the magnet strips, thereby permitting production of louder sounds by the transducer.

In addition, the magnetic fields will be particularly intense and properly arranged at the conductor carrying diaphragm sandwiched between two identical magnetic backings which have like pole faces confronting each other, as to nearly maximize efficiency of the transducer.

A BRIEF DESCRIPTION OF THE DRAWINGS

FIG. 9 is a detail plan view of a modified form of magnet construction.

DETAILED SPECIFICATION

Figure 1:
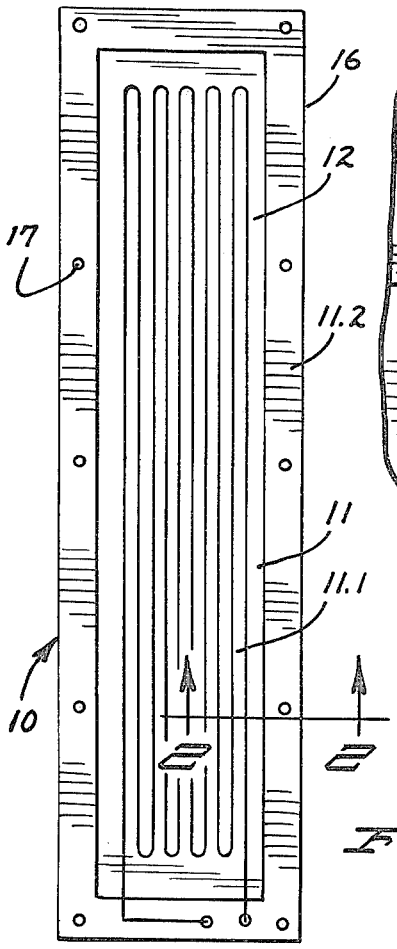
FIG. 1 is an elevation view of a transducer incorporating the present invention.
Figure 3:
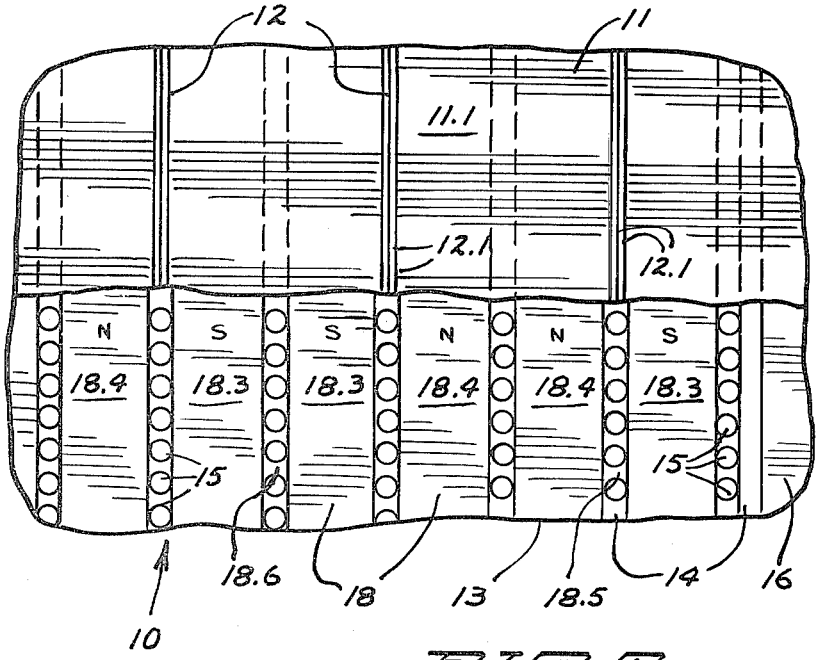
FIG. 3 is a greatly enlarged detail elevation view, partly broken away for clarity of detail, of the transducer.
Figure 2:
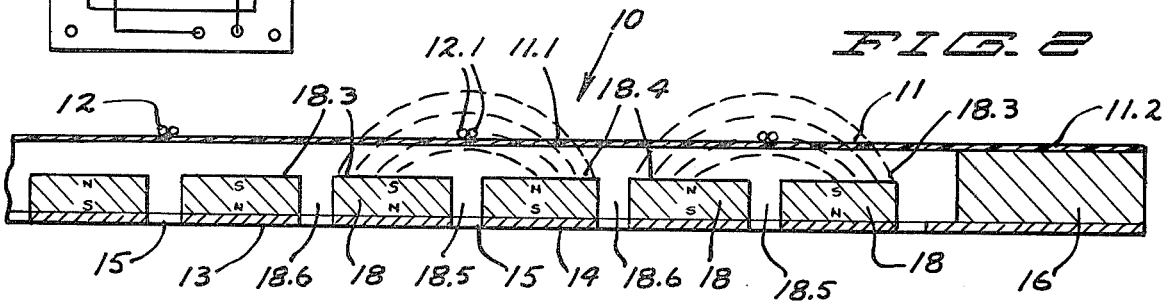
FIG. 2 is an enlarged detail section view taken at 2—2 of FIG. 1.

A diaphragm type magnetic transducer or loud speaker is illustrated in one form in FIGS. 1–3 and is indicated in general by the numeral 10. The loud speaker may be in any of a large range of sizes. The speaker may be especially adapted for mid-range bass frequencies in a size of 3 to 5 feet long and 6 to 12 inches wide. The speaker may also incorporate a tweeter section. Also, the speaker may be rectangular or oblong or circular as small as 3 inches in diameter or smaller. The speaker 10 includes a diaphragm 11 having a vibratable area 11.1 disposed inwardly from the outer periphery 11.2 which is secured as by adhesive to the spacer on frame 16. The vibratable area 11.1 of the diaphragm has a multiplicity of elongate and parallel runs 12 of signal carrying conductors or strands 12.1. The runs 12 may include single or multiple strands of the conductors as seen in FIGS. 2 and 3.

The transducer also includes a substantially rigid and acoustically transparent magnetic backing 13 confronting substantially the entire diaphragm 11. The magnetic backing has a substantially rigid acoustically transparent plate 14 of magnetic material such as soft iron or steel, which has a multiplicity of aperatures 15 therein. The edges of the plate 14 are secured to the spacer or frame 16 to which the periphery of the diaphragm is affixed. Mechanical fasteners such as rivets 17 may be utilized for securing the spacer to the edge portions of the plate 15.

Figure 6:
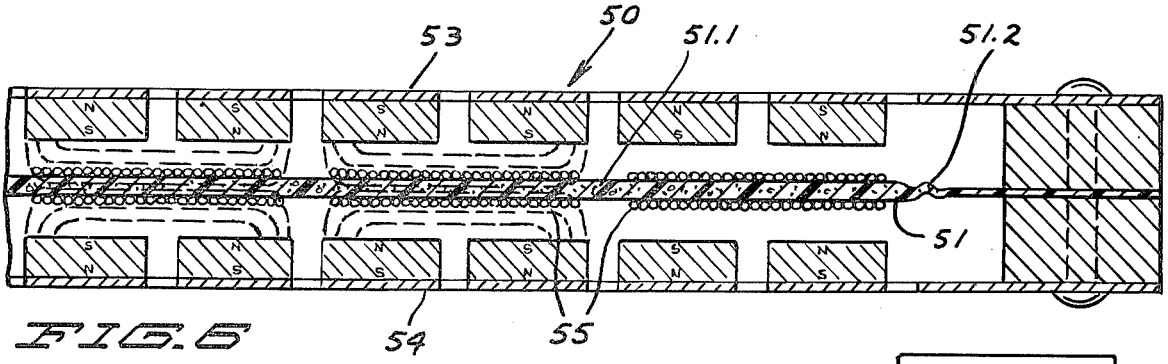
FIG. 6 is a detail section view illustrating still another modified form of the invention.

The diaphragm may be formed of various materials and it has been found successful to form the diaphragm 11 of a polyester film known by its trademark as Mylar. Typically, the diaphragm will have a thickness on order of 0.00025 to 0.0005 inches. Also, other films such as saran or plyofilm which is basically a rubber type material, or paper, catgut, or polyethylene may be utilized in the diaphragm. In addition, the diaphragm may be constructed with a substantially stiff and non-flexing vibratable area, of honeycombed styrofoam or similar material as illustrated in FIG. 6.

Figure 5:
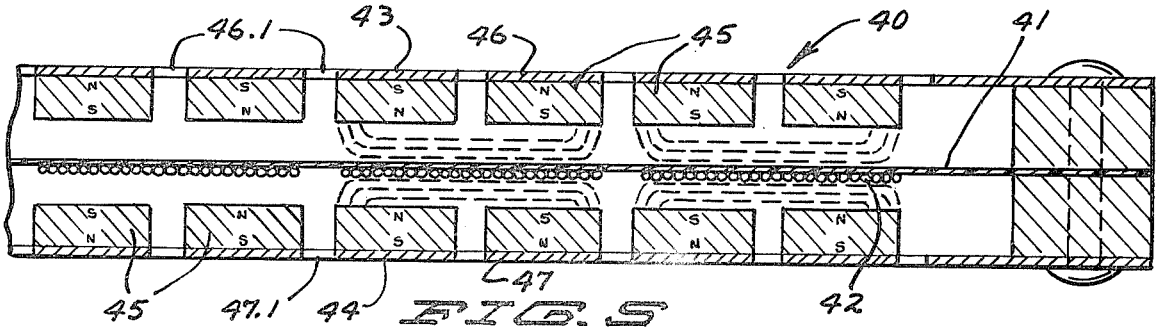
FIG. 5 is a greatly enlarged detail section view illustrating another modified form of the invention.

Also, although the conductor runs in FIGS. 2 and 3 only show the use of two strands of conductors, a multiplicity of conductor strands in each run may be utilized on the diaphragm 11, substantially as illustrated in FIG. 5. It will be understood that the strands of conductors are secured by adhesives to the diaphragm 11 to retain them in the precisely desired locations, hereinafter more fully referred to. Conductors may range in size from 24 gauge to 32 gauge, or larger or smaller, depending upon the current to be carried.

The magnetic backing also includes a multiplicity of elongate strips 18 of magnet material, spaced from each other and lying on the plate 14 in spaced relation with the diaphragm 11. The strips 18 do not signficantly obstruct the apertures 15 in the magnetic plate 14 as to produce any acoustical loading of the diaphragm in its normal operation. The strips 18 are magnetized as hereinafter described in detail and are referred to as magnetized strips.

The magnetized strips 18 may be formed of any of a number of materials which may be flexible or rigid. The magnetized strips are typically formed of a flexible rubber bonded barium ferrite magnetic material known by its trademark Plastiform of the 3M Company, St. Paul, Minn. In addition, the magnetized strips may be formed of samarium cobalt in a polymer binder or the magnetized strips may be scintered samarium cobalt, or also ceramic magnets or similar types of magnets available in strip form may be used. Although it may be desirable that the magnetized strips 18 extend the full length of the transducer 10 as seen in FIG. 1, the magnetized strips may be used in short sections placed end to end as to effectively fabricate elongate end to end strips. The abutted ends 18.1 of certain magnetized strips are seen in FIG. 3.

Also, the magnet strips may be incorporated into a sheet of magnetic material or may be connected together by narrow bridges 18.1 as illustrated in FIG. 9, so that the magnetized strips are a part of a single panel 18.2 with slots 18.3 formed during molding or by punching after molding is complete.

All of the magnetized strips 18 are magnetized in a direction normal to the plate 14 and diaphragm 11 so as to define magnetic poles at the front faces 18.2 of the magnetized strips which face the diaphragm 11. Certain of the magnetized strips 18 are magnetized so that there are south magnetic poles at their front faces 18.3; and other of the magnet strips are magnetized so that there are north magnetic poles at their front faces 18.4. It will be evident in FIGS. 2 and 3 that the sequence of pole faces on the magnetized strips is south, north, north, south, south, north, north, et seq. Each adjacent magnet strip which has a north magnetic pole at its front face 18.4 establishes a magnetic field in cooperation with the next adjacent magnet strip with a south pole at its face 18.3. Such a functional pair of magnetized strips with opposite magnetic poles at their front faces 18.3, 18.4, and disposed opposite a run 12 of the signal carrying conductors on the diaphragm. There is a space 18.5 between the magnetized strips 18 of each functional pair of strips.

It will also be seen that there is a space 18.6 between each functional pair of strips 18. Adjoining each space 18.6 are magnetized strips with like magnetic poles at their front faces. As a result, there is essentially no magnetic field at the diaphragm opposite the spaces 18.6.

Figure 7:
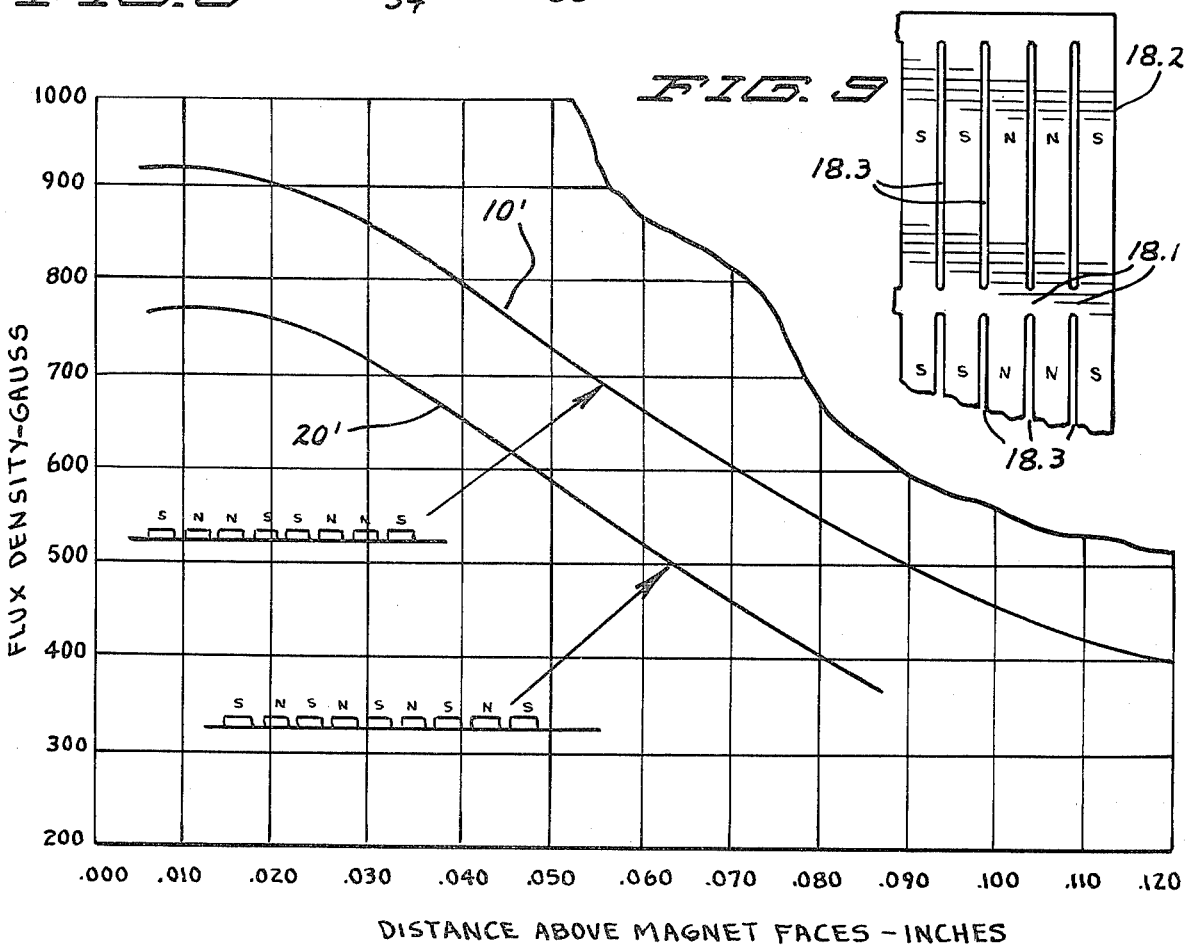
FIG. 7 is a graph illustrating the performance characteristics of certain transducers incorporating the present invention as compared to a transducer incorporating the magnetic circuit of the prior art.
Figure 8:
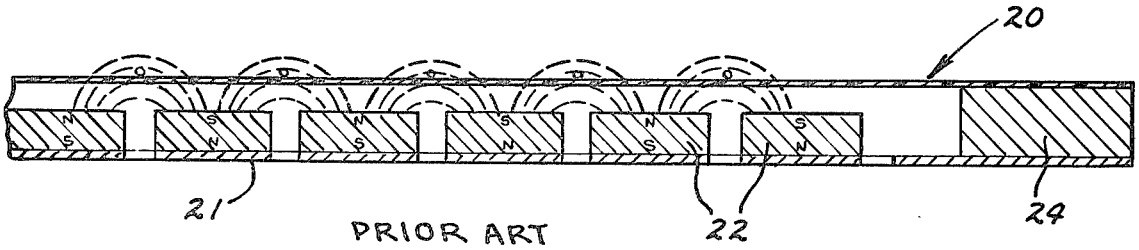
FIG. 8 is a detail section view illustrating the prior art form of magnetic circuit utilized in diaphragm type magnetic speakers.

FIG. 7 dramatically shows the increase in the magnetic field by reason of the improved magnetic circuit illustrated in FIGS. 1–3 as compared to a diaphragm type magnetic transducer with a magnetic circuit as used in the prior art, as illustrated in FIG. 8. In FIG. 8, the magnetic backing 20, utilizing a plate 21 of magnetic material, such as a soft iron, has magnetized strips 22 laid thereon in spaced relation to each other and confronting the vibratable area 23 of the diaphragm which is adhesively secured to the spacer 24 which affixes the periphery of the diaphragm to the edge portions of the plate 21 of magnetic material.

The traditional magnetic circuit utilizing the magnet strips 22 is illustrated in FIG. 8, and the polarity of the magnetic fields is reversed in all of the strips adjacent each other across the width of the transducer 20. In other words, alternate magnetic strips have north poles at their front faces 25; and the remainder of the magnet strips which also are alternate have south poles at the front faces 26.

Accordingly, the magnetic field as illustrated in FIG. 8 defines a magnetic field in the space between each of the magnet strips, and a run of conductor 27 is located opposite the space between each of the adjacent magnetized strips.

This prior art transducer of FIG. 8 is substantially identical in all respects to the transducer 10 of FIGS. 1–3 with the exception of the magnetic field occasioned by placing the magnet strips 18 of the transducer 10 in a different pattern, as illustrated. Also, although the total number of strands and total length of wire is the same as between 8 on the one hand and FIGS. 1–3 on the other hand, the transducer 10 has the strands grouped together or clustered in the magnetic fields as illustrated in FIGS. 2 and 3.

In FIG. 7, which compares the strength of the magnetic field of the prior art transducer 20 in curve 20' with the magnetic field strength of the transducer 10 in the curve 10', it will be seen that for the same volume of magnetic material in the two magetic circuits and with the same soft iron plates on which the magnetized strips are laid, the magnetic circuit of the prior art transducer 20 in FIG. 8 establishes that a magnetic field of 650 gauss at a distance of approximately 0.042 inches from the front faces of the magnet strips, whereas, the transducer 10 with the improved magnetic circuit establishes magnetic field of 650 gauss at a spacing of 0.063 inches above the front faces of the magnet strips. Because in both the transducer 10 and 20, the magnetized strips are spaced apart identically and the same proportion of the plates 14 and 21 are open, there is no change in acoustical loading. However, because a magnetic field of 650 gauss is established at a distance approximately half again as great from the faces of the magnet strips in transducer 10 as compared to the spacing from the magnet front faces in transducer 20, the diaphragm 11 of transducer 10 may be spaced significantly farther from the faces of the magnet strips without losing operating efficiency of the transducer.

The increased spacing permissible with the improved magnetic circuit of transducer 10 permits the transducer 10 to operate on higher output level without the diaphragm bottoming against or slapping the magnet strip faces. This is especially important in transducers intended to produce the bass and mid-range audio frequency sounds and in smaller transducers where producing a sufficient volume of sound may be a problem. In comparing the improved magnetic circuit of transducer 10 with the prior art magnetic circuit of transducer 20, it will be recognized that the same volume of magnet material is used in the improved magnetic circuit of transducer 10 so that costs are not increased and acoustical loading is not changed.

Figure 4:
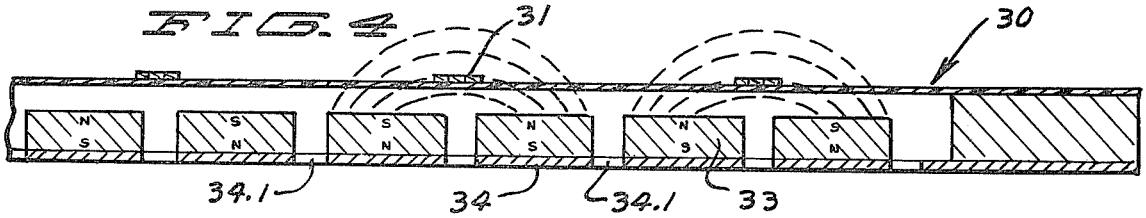
FIG. 4 is a detail section view of a modified form of the transducer.

Other forms of transducers illustrated in FIGS. 4–6 illustrate variations in transducers that may be utilized with the improved magnetic circuits. In FIG. 4, the transducer 30 utilizes the identical magnetic circuit of FIG. 1, but illustrates the use of conductors 31 made of foil or metal deposited on the diaphragm 32 and etched away into individual strands of conductor. This transducer 30 also illustrates that the band of conductors 31 may have a width which is considerably wider than the spacing between the individual magnet strips 33, the front faces of which are oppositely polarized. Again, the soft iron plate 34 is apertured at 34.1. The shape of the magnetic fields established by the improved magnetic circuit will accommodate significantly wider bands of clustered conductors 31. This use of wider bands of conductors may also be utilized in connection with round wires as illustrated in the other transducers. The foil conductors may have a thickness in the range of 0.010 inches more or less, depending upon the amount of current to be carried. The individual conductor strands are insulated from each other by spaces having roughly the same width as the thickness of the foil or strands.

In the transducer 40 of FIG. 5, the diaphragm 41 with bands of clustered conductors 42 adhesively secured on the diaphragm, is sandwiched between two substantially identical magnetic backings 43 and 44. In this form of transducer 40, all of the magnetized strips 45 which are directly opposite each other, have like magnetic poles at their confronting front faces. As a result, the magnetic fields produced on both sides of the diaphragm in the vicinity of the conductor bands are substantially flat in configuration and the lines of magnetic flux lie parallel to the diaphragm and will accommodate wider bands of conductors than possible with a similar transducer of identical size with a prior art magnetic circuit. The metal plates 46 and 47 of the two magnetic backings 43 and 44 have apertures 46.1, 47.1 to make the backings acoustically transparent. In some instances, it may be desirable to carry conductor runs on both faces of the diaphragm.

In the transducer 50 of FIG. 6, the same identical improved magnetic circuit of transducers 10 and 40 is utilized. In this form, the diaphragm 51 is substantially stiff and non-flexible, and all portions of the central vibratable area of the diaphragm have the same motion, in a piston-like manner. The diaphragm 51 has a surround or flexible joint 51.2 connecting the vibratable area 51.1 with the peripheral portions of the diaphragm which are clamped to the acoustically transparent magnetic backings 53 and 54. Runs 55 of signal carrying conductors are carried on the vibratable area 51.1 of the diaphragm for producing reaction with the magnetic fields and causing vibration of the stiff and non-flexing vibratable area of the diaphragm.

It will be seen that the improved magnetic circuit of the diaphragm type magnetic transducer produces a significantly more intense magnetic field extending signficantly further out from the front faces of the magnet strips as compared to the prior art magnetic circuit so as to improve the efficiency of the transducer utilizing the improved magnetic circuit while allowing the spacing between the magnetic strips and the diaphragm to be significantly increased. The transducer has more power handling capability and may be driven harder to produce more output and still avoid the bottoming or slapping by the diaphragm onto the faces of the magnet strips.

What is claimed is:

1. A transducer to carry a signal current, comprising a diaphragm having a vibratable area with a number of elongate signal carrying conductor runs thereon, the diaphragm also having a periphery adjacent the vibratable area, a substantially rigid magnetic backing confronting the diaphragm and having anchoring means to which the diaphragm is secured, the magnetic backing having a multiplicity of spaced permanent magnet strips with front faces in confronting and spaced relation with the diaphragm, the magnet strips being magnetized in an orthogonal direction relative to the diaphragm and with magnetic poles located at said front faces, the magnetized strips being arranged in functional pairs, wherein each pair has opposite magnetic poles at the front faces of the respective strips in the pair to project a magnetic field toward the diaphragm, each pair of magnet strips confronting and extending along one of the conductor runs to cause the magnetic field to embrace the conductor run, and the magnet strips adjacent each other and respectively included in adjacent functional pairs being of like polarity at their front faces.

2. The transducer according to claim 1 and the magnetized strips in each of said pairs of strips being spaced from the strips of adjacent pairs.

3. The transducer according to claim 1 and a second magnetic backing confronting the diaphragm and cooperating with said first mentioned magnetic backing in sandwiching the diaphragm therebetween, the magnetized strips of the second magnetic backing having polarities confronting magnetized strips of like polarity of the first mentioned magnetic backing, one of the first mentioned or second magnetic backings being acoustically transparent.

4. The transducer according to claim 1 wherein the magnetic backing includes an apertured plate of a magnetic material against which the magnetized strips lie.

5. The transducer according to claim 1 wherein the diaphragm is constructed of flexible film which flexes to accommodate vibration of said vibratable area.

6. The transducer according to claim 1 wherein the diaphragm is stiff and resists flexing and has a flexible periphery as to allow the whole vibratable area to have substantially the same movement during vibration.

7. The transducer according to claim 1 wherein the magnet strips in each functional pair of magnet strips are spaced from each other.

8. The transducer according to claim 1 and a second magnetic backing confronting the diaphragm and cooperating with the said first mentioned diaphragm in sandwiching the diaphragm therebetween, the magnetized strips in both magnetic backings being opposite each other and of like polarity, the conductor runs including a band of conductor strands with a width traversing a functional pair of magnetized strips, one of the first mentioned or second magnetic backings being acoustically transparent.

9. A transducer to carry a signal current, comprising a diaphragm having a vibratable area with a number of elongate signal carrying conductor runs thereon, the diaphragm also having a periphery adjacent the vibratable area, a substantially rigid magnetic backing confronting the diaphragm and having anchoring means to which the diaphragm periphery is secured, the magnetic backing including a low reluctance armature plate and the magnetic backing having a multiplicity of first and second permanent magnet strips lying on the armature plate and having front faces in confronting and spaced relation with the diaphragm, the magnet strips being magnetized in a direction transversely to the disphragm and armature plate, said first magnetized strips having north poles at the front faces and said second magnetized strips having south poles at the front faces, the magnetized strips being in functional pairs wherein each pair includes a first and a second magnetized strip, each pair of magnetized strips confronting and extending along one of the conductor runs, adjacent functional pairs of magnetized strips being arranged with the first magnetized strips of adjacent functional pairs being adjacent to each other and second magnetized strips of adjacent pairs also being adjacent each other.

10. A transducer to carry a signal current, comprising a diaphragm having a vibratable area with a number of elongate signal carrying conductor runs thereon, the diaphragm also having a periphery adjacent the vibratable area, a substantially rigid magnetic backing confronting the diaphragm and having anchoring means to which the diaphragm periphery is secured, and the magnetic backing having a multiplicity of regularly spaced permanent magnet strips with front faces in confronting and spaced relation with the diaphragm, the magnet strips being magnetized in a direction normal to the diaphragm whereby the front face of each magnetized strip has a predetermined magnetic polarity, the magnetized strips being arranged in predetermined sequence relative to each other and with the polarities of the front faces defining the repeating sequence of polarities, to wit: south, north, north, south, south, north, north, south, et seq, each adjacent pair of magnetized strips the front faces of which are oppostely polarized being opposite one of the conductor runs on the diaphragm.

11. The transducer according to claim 10 wherein the conductor runs have substantially the same width as the overall width of said pair of magnetized strips and the space therebetween.

12. The transducer according to claim 10 and the spaced magnet strips being connected together by spaced narrow transverse bridges.

13. A magnetic circuit for a conductor carrying diaphragm type magnetic transducer, comprising an apertured soft iron plate, and a multiplicity of elongate and regularly spaced permanent magnet strips lying on the plate and along each other to confront such a diaphragm, the strips being magnetized in a direction normal to the plate as to define a magnetic pole at the front face of each magnetized strip facing away from the plate, each magnetized strip with a polarity at its front face being adjacent another magnetized strip with like polarity at its front face, and each magnetized strip also being adjacent another magnetized strip with opposite polarity at its front face.

14. The magnetic circuit according to claim 13 wherein the magnetized strips are arranged in predetermined sequence relative to each other and the front faces are polarized in the sequence south, north, north, south, south, north, north, south, et seq.

15. The magnetic circuit according to claim 13 and the spaced magnetized strips being connected with each other in a panel, there being spaced narrow bridges between the magnet strips.

16. The magnetic circuit according to claim 13 and including a second soft iron plate and a second set of permanent magnet strips, said second plate and second strips being the same and arranged the same as said first mentioned plate and stripes, and said second plate and stripes being fixed in confronting and spaced relation with said first mentioned plate and strips to receive the diaphragm therebetween, pole faces of like polarity in said first mentioned and second strips confronting each other to concentrate the magnetic fields along broad bands.

* * * * *

UNITED STATES PATENT AND TRADEMARK OFFICE

CERTIFICATE OF CORRECTION

PATENT NO. : 4,471,172

DATED : September 11, 1984

INVENTOR(S) : James M. Winey

It is certified that error appears in the above-identified patent and that said Letters Patent are hereby corrected as shown below:

Column 8, line 63, delete "disphragm" and substitute --diaphragm--.

Column 10, line 32, delete "stripes" and substitute --strips--; line 33, delete "stripes" and substitute --strips--.

Signed and Sealed this

*Sixteenth* Day of *July 1985*

[SEAL]

*Attest:*

DONALD J. QUIGG

*Attesting Officer* *Acting Commissioner of Patents and Trademarks*